US007377262B2

(12) United States Patent
Oki et al.

(10) Patent No.: US 7,377,262 B2
(45) Date of Patent: May 27, 2008

(54) AIR-FUEL RATIO CONTROLLING APPARATUS FOR AN ENGINE

(75) Inventors: Hideyuki Oki, Saitama (JP); Shusuke Akazaki, Saitama (JP); Yuji Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/703,211

(22) Filed: Feb. 7, 2007

(65) Prior Publication Data

US 2007/0221170 A1 Sep. 27, 2007

(30) Foreign Application Priority Data

Feb. 8, 2006 (JP) ..... 2006-031264

(51) Int. Cl.
*F02D 41/14* (2006.01)

(52) U.S. Cl. ..... 123/435; 123/478; 123/673; 701/104

(58) Field of Classification Search ..... 123/435, 123/478, 480, 501, 502, 673; 701/103, 104
See application file for complete search history.

(56) References Cited

U.S. PATENT DOCUMENTS 6,742,492 B2 * 6/2004 Kimura ..... 123/295
7,178,507 B1 * 2/2007 Gangopadhyay ..... 123/435

FOREIGN PATENT DOCUMENTS

JP 02-099745 4/1990

* cited by examiner

*Primary Examiner*—T. M. Argenbright
(74) *Attorney, Agent, or Firm*—Arent Fox LLP

(57) ABSTRACT

An air-fuel ratio controlling apparatus includes an internal pressure detector for detecting an internal pressure of a combustion chamber of the engine. The apparatus estimates a motoring pressure of the engine and determines a start-of-combustion time, a time point when a difference between the internal pressure and the motoring pressure exceeds a predetermined value in a compression stroke and a combustion stroke of the engine. Firing delay for each cylinder is calculated from as a duration from sparking to the start-of-combustion time. Air-fuel ratio of each cylinder is estimated based on the firing delay and fuel injection amount for each cylinder is calculated to make the air-fuel ratio of plural cylinders uniform.

15 Claims, 6 Drawing Sheets

AIR-FUEL RATIO CONTROLLING APPARATUS FOR AN ENGINE

BACKGROUND OF THE INVENTION

The present invention relates to an air-fuel ratio controlling apparatus for an internal-combustion engine, and in particular it relates to an apparatus for estimating an air-fuel ratio of each cylinder using an internal cylinder pressure sensor to make air-fuel ratio of each cylinder substantially the same.

Sometimes, errors are produced in the amount of intake air into multiple cylinders of an engine with respect to a desired amount due to aging of an air intake system and/or parts of a valve-actuating system and others. Such error differs for each cylinder because the error depends on mechanical factors. A command value for a fuel injection amount to be transmitted to each cylinder is the same for all cylinders because a control is carried out such that air-fuel ratios for all cylinders are the same. Thus, although each cylinder receives the same control command value, unevenness of air-fuel ratio is produced among the plural cylinders.

When air-fuel ratio unevenness is produced among the cylinders, a catalyst purification rate may decrease resulting in poor emission performance. When the unevenness of the air-fuel ratio becomes excessively large, misfiring may take place in the cylinder that is in an excessively lean or rich state. Even when the misfiring does not take place in such a state, drivability will deteriorate as idling vibration, surging or the like may be caused when a significant stepwise torque difference is produced among the cylinders.

The Japanese Patent Application Publication No. H2-99745 discloses a technique comprising detecting a crank angle when internal cylinder pressure reaches maximum as detected with a pressure sensor disposed in each cylinder and estimating an air-fuel ratio of each cylinder based on the crank angle at the time of ignition, thereby controlling an air-fuel ratio of each cylinder. An actual air-fuel ratio is controlled to match a desired air-fuel ratio based on a correlation between variation of an air-fuel ratio in a cylinder and a combustion time.

However, the duration from ignition to firing of air-fuel mixture and the duration from start of firing of air-fuel mixture to the time when the internal pressure reaches a maximum vary depending on fuel characteristics (volatility) and/or an internal temperature of the cylinder. For this reason, if the air-fuel ratio is estimated based on the duration from ignition to the time the internal pressure reaches the maximum, precision of the estimation would be poor, leading to a wrong air-fuel ratio control.

Accordingly, it is an objective of the present invention to provide an apparatus for performing an air-fuel ratio control with a good precision.

SUMMARY OF THE INVENTION

The present invention provides an air-fuel ratio controlling apparatus for an engine in which a firing delay of each cylinder is determined using an internal cylinder pressure sensor. Air-fuel ratio of each cylinder is estimated based on the calculated firing delay. The apparatus includes an internal pressure detector for detecting an internal pressure of a combustion chamber of the engine, estimation means for estimating a motoring pressure of the engine, means for detecting, as a start-of-combustion time, a time point when a difference between the internal pressure and the motoring pressure exceeds a predetermined value during a compression stroke and a combustion stroke of the engine. Thus, a firing delay for each cylinder from ignition to start-of-combustion (firing) is determined. The apparatus further includes means for estimating an air-fuel ratio of each cylinder based on the firing delay and for calculating fuel injection amount for each cylinder such that the air-fuel ratio of each cylinder will become uniform in accordance with the air-fuel ratio.

According to this invention, the firing delay of each cylinder can be calculated accurately based on outputs from the internal cylinder pressure sensor and the air-fuel ratio for each cylinder can be estimated precisely based on the calculated firing delay, so that an accurate air-fuel ratio control can be performed. Since the unevenness of the air-fuel ratios among the cylinders can be resolved by the air-fuel ratio control according to the invention, fluctuation of rotation and/or emission deterioration can be suppressed.

According to one variation of the invention, the estimation means estimates the motoring pressure at every crank angle in accordance with a predetermined calculation equation and the firing delay calculating means further includes correction means for correcting the internal pressure during the compression stroke of the engine such that a deviation of the internal pressure from the motoring pressure may become minimum. The firing delay calculating means detects, as a start-of-combustion time, a time point when a difference between the internal pressure that has been corrected by the correction means and the motoring pressure exceeds a predetermined value.

According to another variation of this invention, the pressure detecting means is provided in each cylinder of the engine. The fuel injection amount calculating means calculates a deviation between an average of the air-fuel ratios of each cylinder and the air-fuel ratio of each cylinder based on a deviation between an average of the firing delays of each cylinder and the firing delay of each cylinder.

According to a further variation of this invention, the apparatus further includes means for calculating a correction coefficient for correcting the air-fuel ratio of each cylinder such that the deviation of the air-fuel ratio may be eliminated. The fuel injection amount calculating means calculates the fuel injection amount to each cylinder using the correction coefficient.

According to a yet further variation of this invention, the correction coefficient calculating means calculates an average of the correction coefficients to normalize the correction coefficient by that average. The fuel injection amount calculating means calculates the fuel injection amount to each cylinder using the normalized correction coefficient.

DESCRIPTION OF THE PREFERRED EMBODIMENTS

Figure 1:
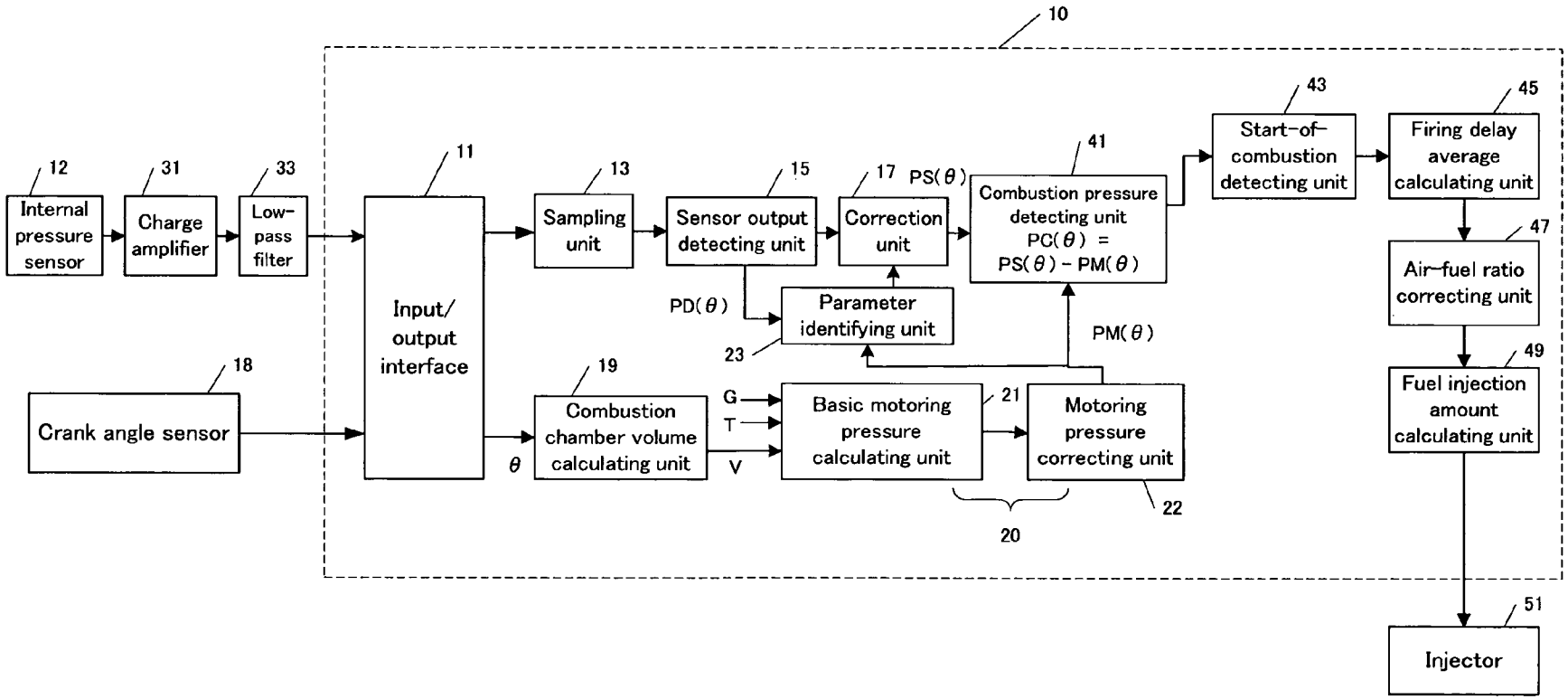
FIG. 1 is a block diagram showing an overall structure of an air-fuel ratio controlling apparatus in accordance with one embodiment of the present invention.

Embodiments of the present invention will be described below with reference to the accompanying drawings. FIG. 1 is a block diagram of an overall structure of an air-fuel ratio controlling apparatus in accordance with one embodiment of the present invention. An electronic control unit 10 is a computer having a central processing unit (CPU). The electronic control unit (ECU) 10 includes a Read-Only Memory (ROM) for storing computer programs and a Random Access Memory (RAM) for providing a working space to the processor and temporarily storing data and programs. An input/output interface 11 receives a detection signal from each section of an engine and performs an A/D (analog to digital) conversion on each signal to deliver it to the next stage. The input/output interface 11 also sends a control signal based on a result of an operation of the CPU to each section of the engine. In FIG. 1, the ECU is shown as functional blocks representing functions related to this invention.

Figure 2:
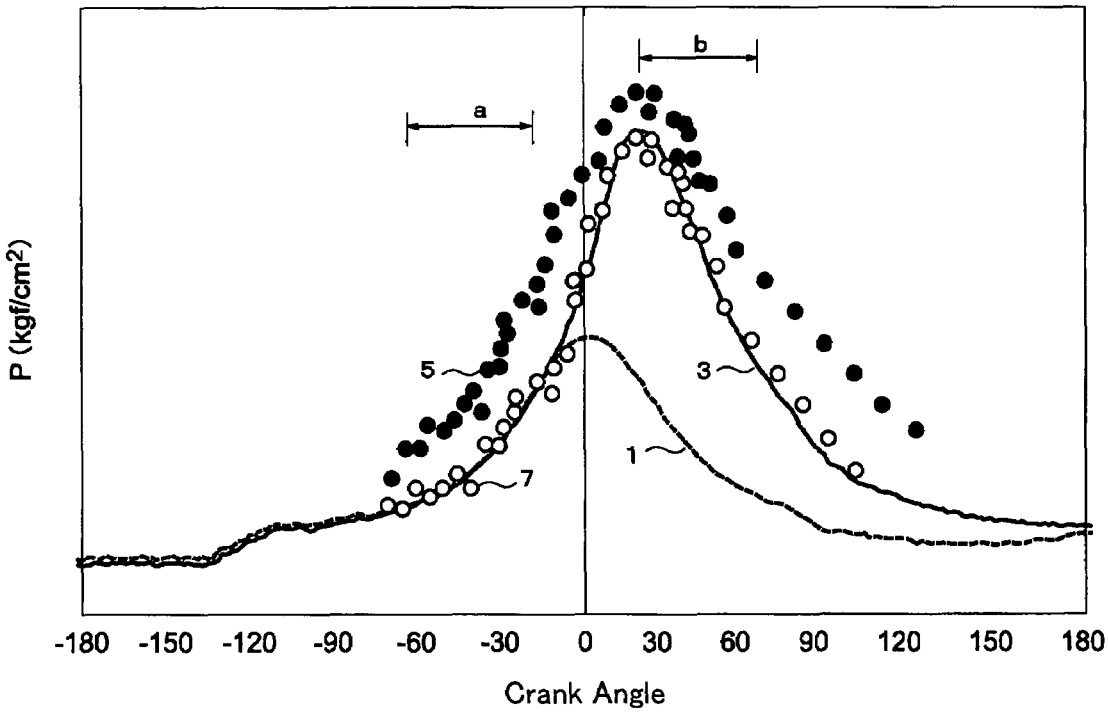
FIG. 2 schematically shows a motoring pressure curve and a curve of a correction value for a sensor output at a combustion time.

At first, a principle of a technique for correcting a sensor output in one embodiment of the present invention will be described below with reference to FIG. 2. FIG. 2 shows pressures of a combustion chamber of a cylinder in a range of −180 degrees to 180 degrees of crank angle. The range of about −180 degrees to 0 degree of crank angle is a compression stroke and the range of about 0 degree to 180 degrees of crank angle is an expansion (combustion) stroke. Curve 1 shows a movement of a motoring pressure (pressure without combustion) of one cylinder of an engine and Curve 3 shows a movement of an internal pressure during normal combustion in the same cylinder. The crank angle of 0 degree is a Top Dead Center (TDC). The motoring pressure reaches a peak at the TDC and the internal pressure during the combustion (Curve 3) reaches a peak around an ignition time after the TDC.

In this embodiment, parameters in a correction equation for correcting a detection output from internal pressure detecting means (the internal pressure sensor 12 of FIG. 1) are identified in a period before the TDC in the compression stroke, for example, a period of "a" shown in FIG. 2. Black dots 5 represent detection outputs from the internal pressure sensor 12. The characteristic of the internal pressure sensor 12 may change due to the influence of the temperature, aging deterioration or the like because the sensor is disposed in a very severe environment in the combustion chamber of the engine. In this embodiment, the detection output of the sensor 12 is corrected such that it follows Curve 1 of the motoring pressure. Such corrected detection outputs are represented by white dots 7.

The correction of the detection output is performed by applying a correction equation $PS=PS(\theta)k_1+C_1$ to the detection output $PS(\theta)$ of the internal pressure sensor 12. $k_1$ is a correction coefficient and $C_1$ is a constant. $\theta$ is crank angle. These two parameters $k_1$ and $C_1$ of this correction equation are calculated using the scheme of least squares minimizing a square of a difference (PM−PS) between an estimated motoring pressure value PM and a value PS obtained by correcting a detection value of the internal pressure sensor according to the above-described correction equation in a certain period, for example, in an interval shown by "a" in FIG. 2 in a compression stroke.

Then, a combustion state can be determined using such corrected sensor output. After the start of the combustion of the air-fuel mixture in the combustion (expansion) stroke, for example, in a period shown as "b" in FIG. 2, a combustion state, for example, occurrence of misfiring, is determined based on a relation between the detection output 7 (white dot) obtained by correcting the output of the internal pressure sensor 12 and the motoring pressure PM (Curve 1) that is calculated through an equation of state. For example, when a ratio of PS/PM is smaller than a predetermined threshold value, it is determined that a misfiring has occurred.

Referring back to FIG. 1, the internal cylinder pressure sensor 12, which is a piezo-electric element, is disposed in the vicinity of a spark plug of each cylinder of the engine. The pressure sensor 12 outputs an electric charge signal corresponding to the pressure inside the cylinder. This signal is converted to a voltage signal by a charge amplifier 31 and passed to the input/output interface 11 through a low-pass filter 33. The input/output interface 11 sends the signal from the pressure sensor 12 to a sampling unit 13. The sampling unit 13 samples the entered signal in a predetermined interval, for example, in an interval of 1/10 kHz and delivers sample values to a detecting unit 15.

A correcting unit 17 corrects the sensor output $PS(\theta)$ in accordance with the above-described correction equation $PS=PD(\theta)k_1+C_1$. The correcting unit 17 provides the sensor output value PS corrected in every 15 degrees of crank angle to a combustion pressure detecting unit 41.

On the other hand, a combustion chamber volume calculating unit 19 calculates a volume $V_c$ of the combustion chamber of the cylinder corresponding to the crank angle $\theta$ in accordance with equations (1) and (2).

$$m=r\{(1-\cos\theta)+\lambda-\sqrt{\lambda^2-\sin^2\theta}\} \tag{1}$$

$$V_c=V_{dead}+A_{pstn}\times M \tag{2}$$

Figure 3:
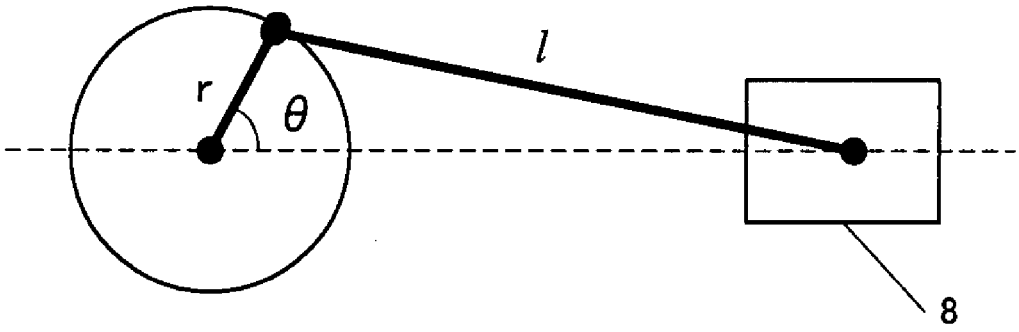
FIG. 3 schematically shows how to calculate a piston position.

In equations (1) and (2), "m" indicates a displacement of a piston 8 from a TDC. The displacement is calculated from a relation shown in FIG. 3. Assuming that "r" is a crank radius and "l" is a length of a connecting rod, $\lambda=l/r$. "$V_{dead}$" represents a combustion chamber volume when the piston is located at the TDC and "$A_{pstn}$" represents a cross-sectional area of the piston.

It is known that an equation of state for a cylinder is generally expressed as in Equation (3).

$$PM=\left(\frac{GRT}{V_c}\right)\times k+C \tag{3}$$

In Equation (3), "G" indicates an intake air amount obtained, for example, from an air flow meter, or based on an engine rotational speed and an intake air pressure. "R" represents a gas constant, "T" represents an intake air temperature obtained, for example, from an intake air temperature sensor, or based on operating conditions such as an engine water temperature etc. "k" is a correction coefficient and C is a constant.

In this embodiment, the pressure of the combustion chamber is actually measured in advance by using a crystal piezoelectric type of sensor that is not influenced by temperature change or the like at the place where the sensor is attached. By matching the actual pressure values to Equation (3), the value $k_0$ for k and the value $C_0$ for C are obtained in advance. Then, the motoring pressure is estimated by using Equation (4) that is obtained by substituting the values $k_0$ and $C_0$ into Equation (3).

$$PM = \left(\frac{GRT}{V_c}\right) \times k_0 + C_0 \tag{4}$$

A motoring pressure estimating unit 20 includes a basic motoring pressure calculating unit 21 and a motoring pressure correcting unit 22. The motoring pressure calculating unit 21 calculates a basic motoring pressure GRT/V that is a basic term in Equation (3). The motoring pressure correcting unit 22 corrects the basic motoring pressure using the parameters $k_0$ and $C_0$ which are obtained in advance as described above. These parameters $k_0$ and $C_0$ are prepared in advance as a map that can be searched based on parameters indicating engine load conditions such as engine rotational speed and absolute air intake pipe pressure.

In an alternative embodiment, the motoring pressure estimating unit 20 may comprise the basic motoring pressure calculating unit 21 only. In this case, the basic motoring pressure GRT/V calculated by the basic motoring pressure calculating unit 21 is used as the motoring pressure PM.

A parameter determining unit 23 determines parameters $k_1$ and $C_1$ in an correction equation to be used for correcting sensor outputs through the method of least squares to minimize a difference (PM−PS) between an estimated motoring pressure value PM calculated during a compression stroke by the motoring pressure estimating unit 20 and an internal pressure PS that is provided by the sensor output correcting unit 17. The sensor output detecting unit 15 samples the output of the pressure sensor in a period of 1/10 kHz for example. The sensor output detecting unit 15 provides an average of the sample values as a sensor output value PS(θ) to a parameter determining unit 23 in a timing that is synchronized with the crank angle. The parameter determining unit 23 identifies parameters of the correction equation in a compression stroke of a cylinder. The identification operation obtains $k_1$ and $C_1$ through the known scheme of least squares for minimizing $(PM(\theta)-PD(\theta)k_1-C_1)^2$, that is, a square of a difference between an estimated motoring pressure value PM(θ) obtained by the motoring pressure correcting unit in accordance with the crank angle and a value PS obtained by applying the correction equation $PS=PD(\theta)k_1+C_1$ to the sensor output value PD(θ) in the same crank angle.

By expressing discrete values of the PM with y(i) and sample values (discrete values) of the internal pressure PD obtained from the internal pressure sensor with x(i), they can be expressed by $X(i)^T=[x(0), x(1), \ldots, x(n)]$ and $Y(i)^T=[y(0), y(1), \ldots, y(n)]$. A sum of squares of the discrete values of the error is expressed as in Equation (5). It is assumed that the sample value is taken in an interval of 1/10 kHz and the value of "i" is limited up to, for example, 100.

$$\begin{aligned} F &= \sum [(kx(i)+C)-y(i)]^2 = \sum [y(i)-(kx(i)+C)]^2 \\ &= \sum [y(i)^2 - 2y(i)\times(kx(i)+C) + (kx(i)+C)^2] \end{aligned} \tag{5}$$

k and C for minimizing the value of F are obtained as the values of k and C when a partial differential with respect to each of k and C for F(k, C) becomes zero. These values are obtained through Equation (6) and Equation (7).

$$\partial F/\partial k = \Sigma[-2y(i)x(i)+2kx(i)^{2+2}Cx(i)]=0 \tag{6}$$

$$\partial F/\partial C = \Sigma[-2y(i)+2kx(i)]=0 \tag{7}$$

By simplifying the right sides of these equations, Equation (6)' and Equation (7)' are obtained.

$$\Sigma y(i)x(i)=k\Sigma x(i)^2+C\Sigma x(i) \tag{6'}$$

$$\Sigma y(i)=k\Sigma x(i)+C\times n \tag{7'}$$

Matrix expression of these equations is Equation (8).

$$\begin{bmatrix} \sum y(i)x(i) \\ \sum y(i) \end{bmatrix} = \begin{bmatrix} \sum x(i)^2 & \sum x(i) \\ \sum x(i) & n \end{bmatrix} \begin{bmatrix} k \\ C \end{bmatrix} \tag{8}$$

Equation (8) can be transformed into Equation (9) using an inverse matrix.

$$\begin{bmatrix} k \\ C \end{bmatrix} = \begin{bmatrix} \sum x(i)^2 & \sum x(i) \\ \sum x(i) & n \end{bmatrix}^{-1} \begin{bmatrix} \sum y(i)x(i) \\ \sum y(i) \end{bmatrix} \tag{9}$$

The inverse matrix in the right side is expressed as in Equation (10).

$$\begin{bmatrix} \sum x(i)^2 & \sum x(i) \\ \sum x(i) & n \end{bmatrix}^{-1} = \frac{1}{\mathrm{DET}} \begin{bmatrix} n & -\sum x(i) \\ -\sum x(i) & \sum x(i)^2 \end{bmatrix} \tag{10}$$

$$\mathrm{DET} = \sum x(i)^2 \times n - \sum x(i) \times \sum x(i)$$

(where, DET ≠ 0)

The sensor output correcting unit 17 corrects the sensor output PD(θ) in a combustion stroke using such identified parameters.

The corrected sensor output PS(θ) for every predetermined crank angle (for example, 15 degrees) is delivered to the combustion pressure detecting unit 41. In one embodiment, the sensor output correcting unit 17 may be omitted. In this case, the output PD(θ) from the sensor output detecting unit 15 for every predetermined crank angle is used as the sensor output PS(θ).

The combustion pressure detecting unit 41 calculates a pressure PC(θ) that is generated purely through combustion when the air-fuel mixture burns in the cylinder of the engine. Referring to FIG. 2, the pressure PS(θ) (Curve 3) detected based on the output of the pressure sensor 12 is shown as an addition of the pressure PC(θ) generated through the combustion to the motoring pressure PM(θ) that is the cylinder pressure at the time of no combustion. Therefore, PC(θ) can be calculated by an equation PC(θ)=PS(θ)−PM(θ).

Figure 4:
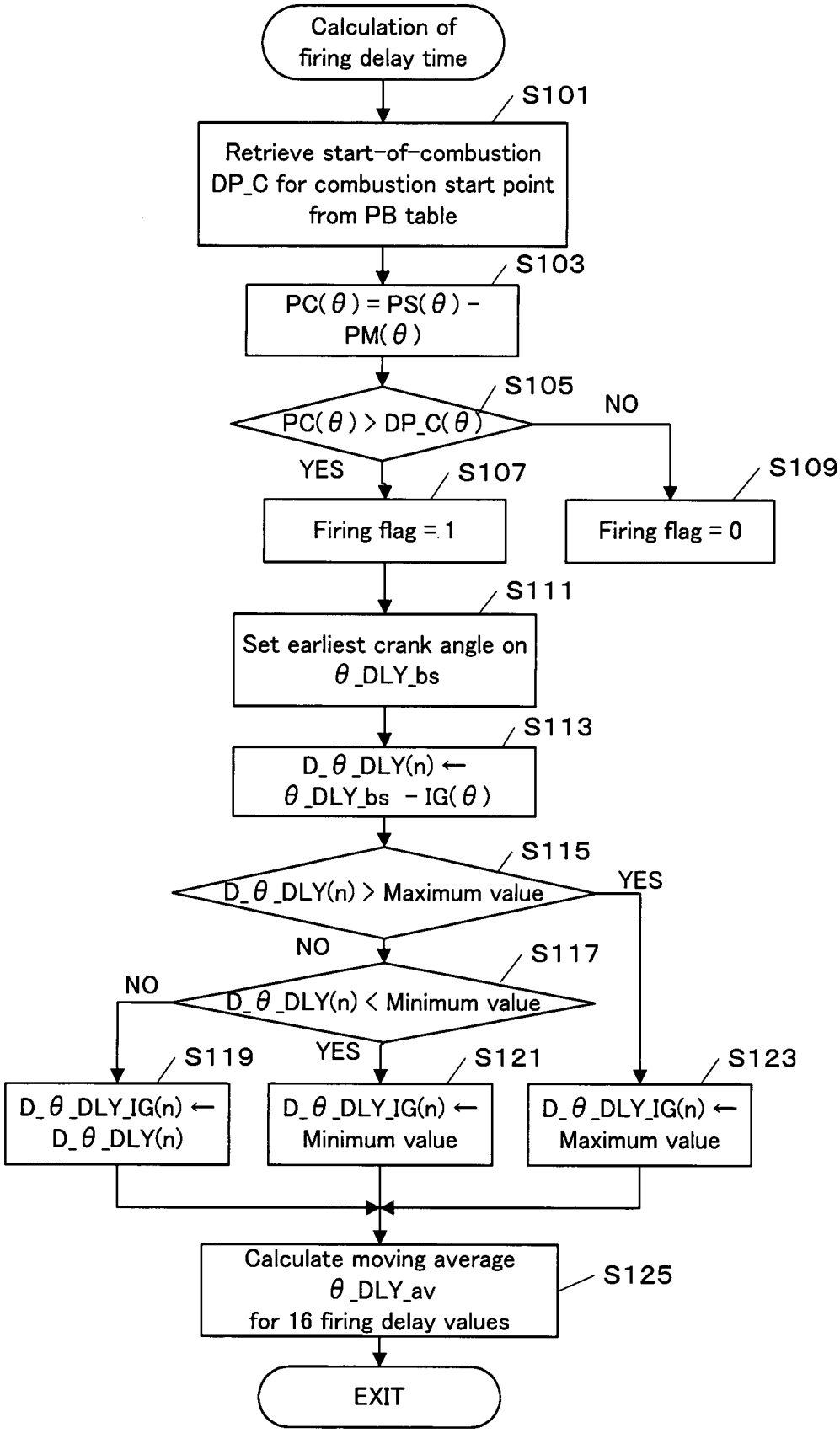
FIG. 4 is a flowchart of a main process for calculating a firing delay.

Referring to FIG. 4, a combustion start detecting unit 43 retrieves a determination value DP_C for determining a start-of-combustion point from a table using the intake air pressure PB as a parameter (S101). When the combustion pressure PC(θ) that is calculated as described above (S103) exceeds the determination value (S105), a firing flag is set to a value of 1 (S107). The calculated combustion pressure PC(θ) vibrates around the start-of-combustion point of the air-fuel mixture. Thus, the crank angle at the time when the PC(θ) first exceeds the determination value is used as the start-of-combustion point. This angle is represented by θ_DLY_bs (S111).

The firing delay calculating unit 45 (FIG. 1) calculates a firing delay D_θ_DLY(n) by subtracting the start-of-combustion point θ_DLY_bs from the crank angle IG(θ) at which the spark plug has been ignited (S113). When the firing delay is larger than a predetermined maximum value (S115), the maximum value is set on a parameter D_θ_DLY_IG(n) to be used for calculating an average (S123). When the firing delay is smaller than a predetermined minimum value (S117), the minimum value is set on the parameter D_θ_DLY_IG(n) (S121). When the firing delay D_θ_DLY_ (n) is between the maximum value and the minimum value, the firing delay is set on the parameter D_θ_DLY_IG(n) (S119). A moving average for sixteen of these parameters D_θ_DLY_IG(n) is used as an average firing delay θ_DLY_av (S125).

Figure 6:
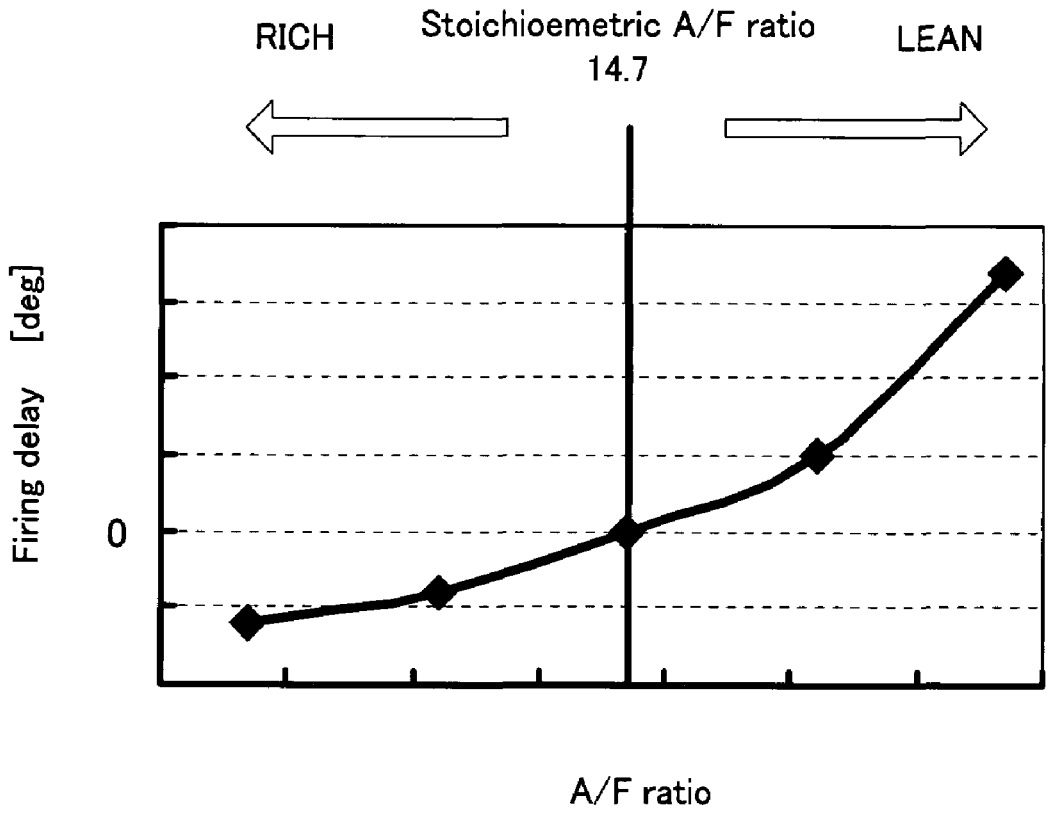
FIG. 6 is a graph showing a relation between a firing delay and an air-fuel ratio.

Now, referring back to FIG. 1, for each bank of the engine, based on the firing delay of each of the cylinders contained in the bank, the air-fuel ratio calculating unit 47 and the fuel injection amount calculating unit 49 correct the air-fuel ratio for each cylinder such that the air-fuel ratio of each cylinder may become uniform. As a result, the fuel injection amount for each cylinder can be adjusted. As shown in FIG. 6, there exists a correlation between the air-fuel ratio and the firing delay. For example, when the air-fuel ratio is a stoichiometric air-fuel ratio of 14.7, the firing delay of the cylinder is 0 [deg] and the air-fuel mixture starts to burn simultaneously with the ignition. As the air-fuel ratio changes toward the leaner state side than the stoichiometric air-fuel ratio, the firing delay of the cylinder increases larger. On the other hand, when the air-fuel ratio is in the richer state than the stoichiometric air-fuel ratio, the mixture starts to burn at the earlier timing than the ignition. Thus, a feedback control of the air-fuel ratio is performed by estimating the air-fuel ratio based on the firing delay of each cylinder and correcting the air-fuel ratio of each cylinder to adjust the fuel injection amount to each cylinder, thereby achieving a uniform air-fuel ratio for plural cylinders.

Figure 5:
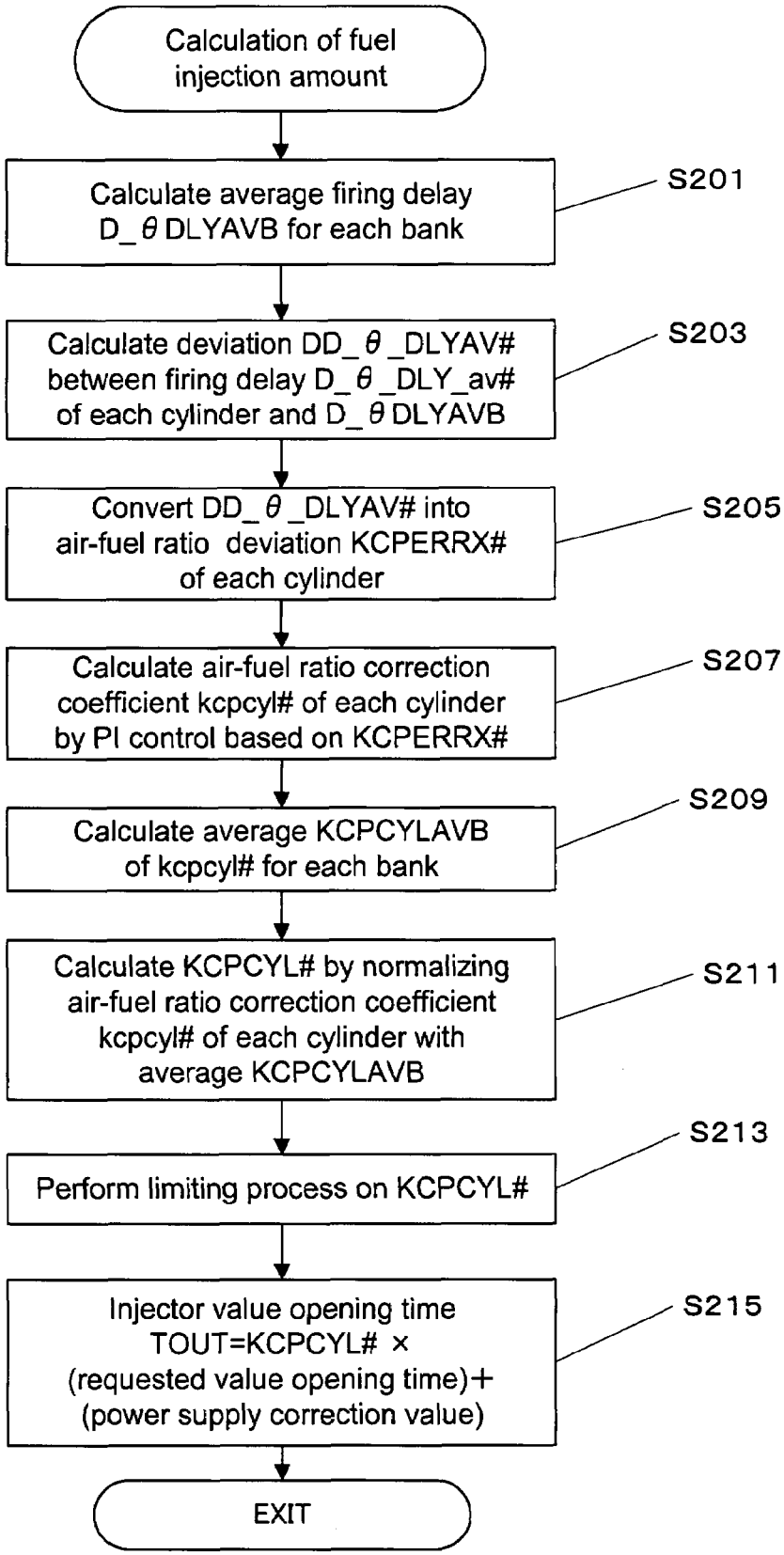
FIG. 5 is a flowchart of a process for calculating a fuel injection amount of each cylinder.

Referring to FIG. 5, the air-fuel ratio correcting unit 47 first obtains an average firing delay D_θ DLYAVB for each bank based on the firing delay θ_DLY_av# (# indicates the serial number of the cylinder) of each cylinder which is calculated by the average firing delay calculating unit 45 (S201) and calculates a deviation DD_θ DLYAV# between the firing 10 delay θ_DLY_av# of each cylinder and the average D_θ DLYAVB in accordance with Equation (11) (S203).

$$DD_\theta\mathrm{DLYAV\#}=\theta_DLY_av\#-D_\theta\mathrm{DLYAVB} \tag{11}$$

where # indicates the serial number of the cylinder. The deviation is calculated for each cylinder.

Subsequently, the deviation DD_θ DLYAV# of the firing delay of each cylinder is converted into a deviation KCPERRX# of the air-fuel ratio (S205). This conversion is carried out, for example, by utilizing a conversion map that is based on the correlation between the air-fuel ratio and the firing delay as shown in FIG. 6. Herein, the deviation KCPERRX# of the air fuel ratio represents a deviation between the air-fuel ratio of each cylinder and an average of the air-fuel ratios of all cylinders within the concerned bank.

As an alternative approach to Step S201 through Step S205, the air-fuel ratio of each cylinder may be estimated by using the conversion map based on the firing delay θ_DLY_av# of each cylinder calculated by the average firing delay calculating unit 45. Then, an average of the air-fuel ratios of all cylinders may be calculated and the deviation KCPERRX# between the estimated air fuel ratio of each cylinder and the average may be calculated.

An air-fuel ratio correction coefficient kcpcyl# of each cylinder is calculated based on the deviation KCPERRX# of the air-fuel ratio of each cylinder as shown in Equation (12) (S207).

$$kcpcyl\#=1-K_P\cdot\mathrm{KCPERRX\#}-K_I\int\mathrm{KCPERRX\#} \tag{12}$$

where Kp and Ki are feedback gains. The second term of the right side of Equation (12) is a proportional term and the third term is an integral term. In other words, Equation (12) calculates a feedback amount for a PI control with its input being KCPERRX#, difference of the air fuel ratio and calculates correction coefficients with a central value of 1.

In Equation (12), a differential term may be added in the right side to perform a PID control. The other feedback control techniques may also be used.

Next, an average KCPCYLAVB of the air-fuel ratio correction coefficients kcpcyl# for each bank is obtained (S209) and the air-fuel ratio correction coefficient of each cylinder is normalized by the average as in Equation (13) (S211).

$$\mathrm{KCPCYL\#}=\mathrm{kcpcyl\#}/\mathrm{KCPCYLAVB} \tag{13}$$

Since the average of the air-fuel ratio correction coefficients becomes 1 because of such normalization, the air-fuel ratio of each bank can be corrected without changing the air-fuel ratio of the whole bank.

A limiting process may be performed on the air-fuel ratio correction coefficient KCPCYL# (S213) and then the correction coefficient KCPCYL# is sent to the fuel injection amount calculating unit 49.

The fuel injection amount calculating unit 49 calculates a valve opening time TOUT of an injector 51 for determining the fuel injection amount in the cylinder in accordance with Equation (14) (S215 of FIG. 15).

$$\mathrm{TOUT}=\mathrm{KCPCYL\#}\times(\text{requested valve opening time})+(\text{voltage supply correction value}) \tag{14}$$

The calculated command value of the valve opening time TOUT is sent to the injector 51.

Thus, the air-fuel ratio of each cylinder within the bank can be uniformed by adjusting the fuel injection amount of each cylinder and correcting the air-fuel ratio.

Although the present invention has been described above with reference to specific embodiments, the present invention is not limited to those specific embodiments. Besides, the present invention can be used for either of a gasoline engine or a diesel engine.

What is claimed is:

1. An air-fuel ratio controlling apparatus for an internal-combustion engine, the apparatus comprising:

means for detecting an internal pressure of a combustion chamber of the engine;

means for estimating a motoring pressure of the engine;

means for detecting, as a start-of-combustion time, a time point when a difference between the internal pressure and the motoring pressure exceeds a predetermined value during a compression stroke and a combustion stroke of the engine, and for calculating for each cylinder a firing delay, a difference between an ignition time and the start-of-combustion time; and means for estimating an air-fuel ratio of each cylinder based on the firing delay in each cylinder and calculating a fuel injection amount for each cylinder to make the air-fuel ratio of plural cylinders uniform.

2. The apparatus of claim 1, wherein said means for estimating a motoring pressure estimates the motoring pressure at every predetermined crank angle in accordance with a predetermined calculation equation; and wherein said means for calculating a firing delay further comprises means for correcting the internal pressure in the compression stroke of the engine such that a difference between the internal pressure and the motoring pressure is minimized, said means for calculating a firing delay detecting, as a start-of-combustion time, a time point when a difference between the internal pressure that has been corrected by said means for correcting and the motoring pressure exceeds a predetermined value.

3. The apparatus of claim 1, wherein said means for detecting pressure is provided in each cylinder of the engine; and wherein said means for calculating fuel injection amount calculates the difference between an average of the air-fuel ratios of each cylinder and the air-fuel ratio of each cylinder based on the difference between an average of the firing delays of each cylinder and the firing delay of each cylinder.

4. The apparatus of claim 3, the apparatus further comprising means for calculating a correction coefficient for correcting the air-fuel ratio of each cylinder such that the deviation of the air-fuel ratio is eliminated, wherein said means for calculating the fuel injection amount calculates the fuel injection amount for each cylinder using the correction coefficient.

5. The apparatus of claim 4, wherein said means for calculating the correction coefficient calculates an average of the correction coefficients to normalize the correction coefficient by the average; and wherein said means for calculating the fuel injection amount calculates the fuel injection amount for each cylinder using the normalized correction coefficient.

6. A method for controlling air-fuel ratio of an internal-combustion engine, comprising:

detecting an internal pressure of a combustion chamber of the engine;

estimating a motoring pressure of the engine;

detecting, as a start-of-combustion time, a time point when a difference between the internal pressure and the motoring pressure exceeds a predetermined value during a compression stroke and a combustion stroke of the engine, and for calculating for each cylinder a firing delay, a difference between an ignition time and the start-of-combustion time; and estimating an air-fuel ratio of each cylinder based on the firing delay in each cylinder and calculating a fuel injection amount for each cylinder to make the air-fuel ratio of plural cylinders uniform.

7. The method of claim 6, wherein said estimating a motoring pressure includes estimating the motoring pressure at every predetermined crank angle in accordance with a predetermined calculation equation; and wherein said calculating a firing delay further comprises correcting the internal pressure in the compression stroke of the engine such that a difference between the internal pressure and the motoring pressure is minimized, said calculating a firing delay includes detecting, as a start-of-combustion time, a time point when a difference between the internal pressure that has been corrected by said correcting and the motoring pressure exceeds a predetermined value.

8. The method of claim 6, wherein said calculating fuel injection amount includes calculating the difference between an average of the air-fuel ratios of each cylinder and the air-fuel ratio of each cylinder based on the difference between an average of the firing delays of each cylinder and the firing delay of each cylinder.

9. The method of claim 8, further comprising calculating a correction coefficient for correcting the air-fuel ratio of each cylinder such that the deviation of the air-fuel ratio is eliminated, wherein said calculating the fuel injection amount includes calculating the fuel injection amount for each cylinder using the correction coefficient.

10. The method of claim 9, wherein said calculating the correction coefficient includes calculating an average of the correction coefficients to normalize the correction coefficient by the average; and wherein said calculating the fuel injection amount includes calculating the fuel injection amount for each cylinder using the normalized correction coefficient.

11. A computer-readable-recording medium storing a computer executable program, the program when executed performing the functions of controlling air-fuel ratio of an internal-combustion engine, comprising:

detecting an internal pressure of a combustion chamber of the engine;

estimating a motoring pressure of the engine;

detecting, as a start-of-combustion time, a time point when a difference between the internal pressure and the motoring pressure exceeds a predetermined value during a compression stroke and a combustion stroke of the engine, and for calculating for each cylinder a firing delay, a difference between an ignition time and the start-of-combustion time; and estimating an air-fuel ratio of each cylinder based on the firing delay in each cylinder and calculating a fuel injection amount for each cylinder to make the air-fuel ratio of plural cylinders uniform.

12. The medium of claim 11, wherein said program further performing:

estimating the motoring pressure at every predetermined crank angle in accordance with a predetermined calculation equation;

correcting the internal pressure in the compression stroke of the engine such that a difference between the internal pressure and the motoring pressure is minimized;

detecting, as a start-of-combustion time, a time point when a difference between the internal pressure that has been corrected by the correcting function and the motoring pressure exceeds a predetermined value.

13. The medium of claim 11, wherein the program further performing:

calculating the difference between an average of the air-fuel ratios of each cylinder and the air-fuel ratio of each cylinder based on the difference between an average of the firing delays of each cylinder and the firing delay of each cylinder.

14. The medium of claim 13, wherein the program further performing:

calculating a correction coefficient for correcting the air-fuel ratio of each cylinder such that the deviation of the air-fuel ratio is eliminated; and calculating the fuel injection amount for each cylinder using the correction coefficient.

15. The medium of claim 14, wherein the program further performing:

calculating an average of the correction coefficients to normalize the correction coefficient by the average; and calculating the fuel injection amount for each cylinder using the normalized correction coefficient.

* * * * *